US010260303B2

(12) United States Patent
Manera et al.

(10) Patent No.: US 10,260,303 B2
(45) Date of Patent: Apr. 16, 2019

(54) IRIS FISHING TOOL OVERSHOT CATCH

(71) Applicant: Baker Hughes Incorporated, Houston, TX (US)

(72) Inventors: Michael Manera, Tomball, TX (US); Rick J. Patterson, Santa Fe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 195 days.

(21) Appl. No.: 15/411,368

(22) Filed: Jan. 20, 2017

(65) Prior Publication Data

US 2018/0209234 A1 Jul. 26, 2018

(51) Int. Cl.
*E21B 31/18* (2006.01)

(52) U.S. Cl.
CPC ..... *E21B 31/18* (2013.01)

(58) Field of Classification Search
CPC ..... E21B 31/18; E21B 31/12; E21B 31/20
See application file for complete search history.

(56) References Cited

U.S. PATENT DOCUMENTS 1,454,819 A * 5/1923 Jones ..... E21B 29/007 166/55.6
1,582,485 A * 4/1926 Sauls ..... E21B 31/18 294/86.21
1,766,177 A * 6/1930 Langstaff ..... E21B 31/20 166/55.7
1,777,592 A * 10/1930 Thomas ..... E21B 31/20 294/86.17
1,788,912 A * 1/1931 Corey ..... E21B 31/18 294/86.17
1,825,025 A * 9/1931 Thomas ..... E21B 31/12 294/86.17
1,825,026 A * 9/1931 Thomas ..... E21B 31/20 294/86.19
2,061,864 A * 11/1936 Wells ..... E21B 31/12 294/86.14
2,072,338 A * 3/1937 Kelso ..... E21B 31/18 294/74
2,075,248 A * 3/1937 Wickersham ..... E21B 31/20 294/86.21
2,427,438 A * 9/1947 Breaux ..... E21B 31/18 294/86.17
2,737,410 A * 3/1956 Stohn ..... E21B 31/20 294/86.17
4,101,157 A * 7/1978 Richey ..... E21B 23/006 166/240
5,054,833 A * 10/1991 Bishop ..... E21B 31/18 294/86.17
2003/0205377 A1* 11/2003 Streater ..... E21B 29/002 166/301

* cited by examiner

*Primary Examiner* — Kipp C Wallace
(74) *Attorney, Agent, or Firm* — Shawn Hunter

(57) ABSTRACT

A gripping assembly for a fishing tool which includes first and second end members and a plurality of gripping members which are retained by the first and second end members and which are moveable between a radially expanded configuration and a radially restricted configuration by rotation of the second end member with respect to the first end member.

15 Claims, 7 Drawing Sheets

IRIS FISHING TOOL OVERSHOT CATCH

BACKGROUND OF THE INVENTION

1. Field of the Invention

The invention relates generally to fishing tools and methods for removing objects from a wellbore.

2. Description of the Related Art

Fishing tools are used to remove stuck objects from a wellbore. Typical fishing tools include a mechanical latch or set of collets which are intended to engage a lip or similar structure on a stuck object, or fish, to be removed. Difficulties arise when the fish is irregularly shaped or lacks a sufficient lip which would allow a conventional fishing tool to securely grip the fish.

SUMMARY OF THE INVENTION

The invention provides a fishing tool design which is useful for removing fish having irregular shapes and/or a lack of gripping structures to which a conventional fishing tool might be secured. An exemplary fishing tool is described which includes an overshot portion which defines an interior chamber.

The overshot portion of the fishing tool includes a gripping mechanism that will radially grip a fish or portion of a fish. The gripping mechanism includes a plurality of gripping segments which are moveably mounted to first and second end members. Rotation of the end members in opposite directions relative to one another will move the gripping segments radially inwardly or radially outwardly between a radially expanded configuration and a radially restricted configuration which is used for gripping a fish. Movement of the gripping members between radially expanded and restricted configurations may have an appearance similar to an iris surrounding a pupil in the eye.

The first end member is secured against rotation while the second end member is not secured against rotation. In described embodiments, the second end member presents a radially outwardly projecting lug which resides within a helical track in a surrounding sleeve so that downward axial movement of the second end member with respect to the sleeve will cause the second end member to rotate with respect to the first end member and the sleeve.

An alternative fishing tool is described in which movement of the gripping assembly with respect to the outer housing is controlled using a J-slot mechanism. In a described embodiment, the gripping assembly includes a J-slot ring from which an arm projects radially outwardly. A J-slot is inscribed within the outer housing. Axial movement of the gripping assembly with respect to the outer housing can only occur when the arm enters an axial leg of the J-slot.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
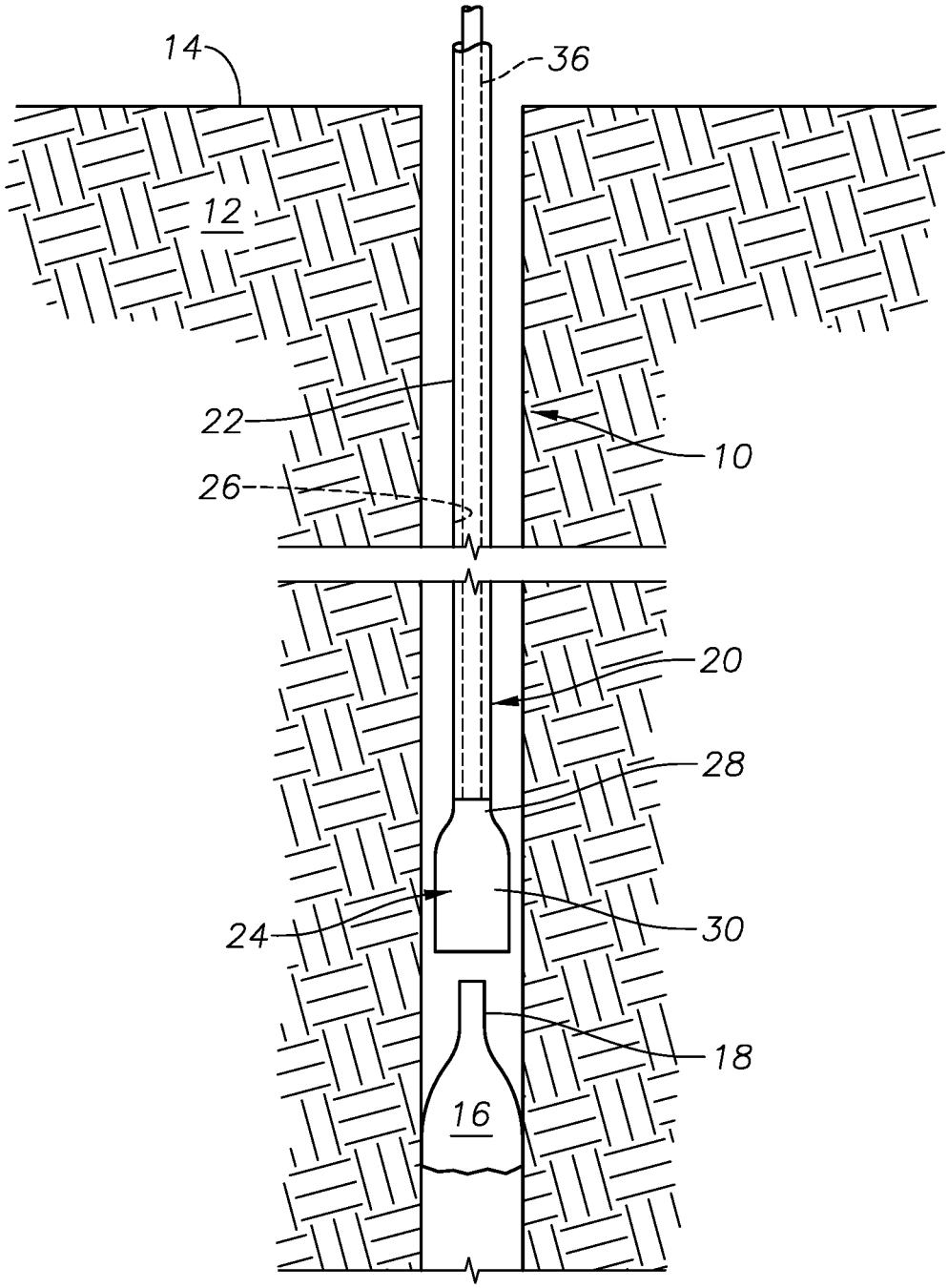
FIG. 1 is a side, cross-sectional view of an exemplary wellbore containing a stuck fish and a fishing arrangement in accordance with the present invention.

FIG. 1 depicts an exemplary wellbore 10 which has been drilled through the earth 12 from the surface 14. An object, or fish, 16 is stuck within the wellbore 10. The fish 16 does not present significant annular projection or lip which could be easily engaged by a latch or collet. However, the fish 16 does present a reduced diameter portion 18.

In FIG. 1, a fishing arrangement, generally indicated at 20, is shown being disposed within the wellbore 10 to remove the fish 16. The fishing arrangement 20 includes a running string 22 with a fishing tool 24 affixed to its distal end. In certain embodiments, the running string 22 is coiled tubing. However, the running string 22 might also be made up of conventional tubular sections which are interconnected in an end-to-end fashion. A fluid flowbore 26 is defined along the length of the running string 22.

Figure 2:
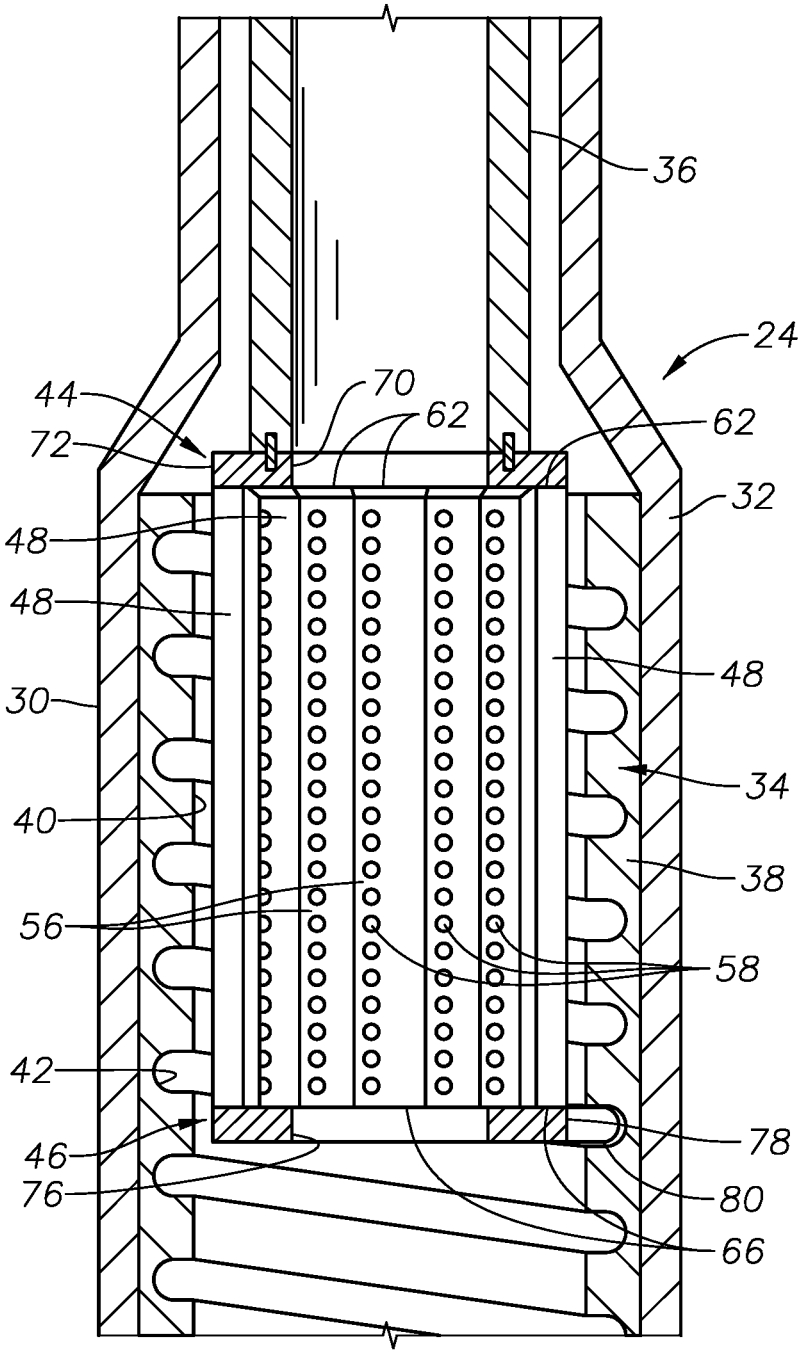
FIG. 2 is a side, cross-sectional view of an exemplary fishing tool constructed in accordance with the present invention.
Figure 3:
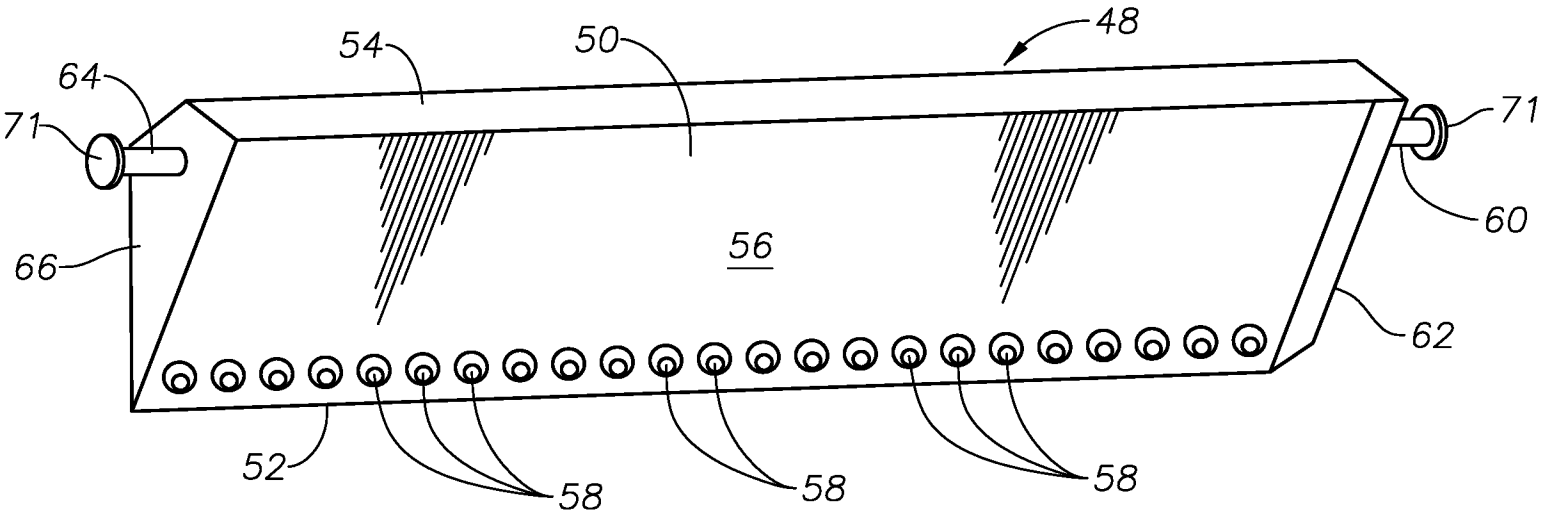
FIG. 3 is an isometric view of an exemplary gripping segment apart from other components of the gripping assembly.

Referring now to FIGS. 2-3, it can be seen that the fishing tool 24 includes a neck portion 28 and an overshot portion 30. The overshot portion 24 will typically have a larger diameter than the neck portion 28. The neck portion 32 includes a threaded to connector for attachment of the fishing tool 24 to the running string 22. As best seen in FIG. 2, the overshot portion 30 includes an outer housing 32 which retains a gripping assembly, generally indicated at 34, within. A tube 36 is disposed within the flowbore 26 of the running string 22. The tube 36 is axially moveable with respect to the running string 22. A sleeve 38 is secured within the outer housing 32 of the fishing tool 24. The sleeve 38 presents an interior radial surface 40 having a helical track 42 inscribed therein.

Gripping assembly 34 includes a first end member 44 and a second end member 46. In currently preferred embodiments, the first and second end members 44, 46 are annular rings which have a central opening. However, other shapes might also be used. A central opening might be absent (for the first end member) or the member may have a non-circular shape. A plurality of gripping segments 48 is retained between the first and second end members 44, 46. A single gripping segment 48 is illustrated in FIG. 3. Each gripping segment 48 includes a rigid, elongated body 50 which presents a wedge-shaped cross-section which extends from interior edge 52 to outer face 54. The gripping segment 48 also presents a gripping face 56 which is designed to contact and engage a portion of a stuck fish. Preferably, conical projections 58 are formed on the gripping face 56 to help form a biting engagement with the fish 16. A first pin 60 extends outwardly from a first axial end 62 of the body 50. A second pin 64 extends outwardly from a second axial end 66 of the body 50.

Figure 5:
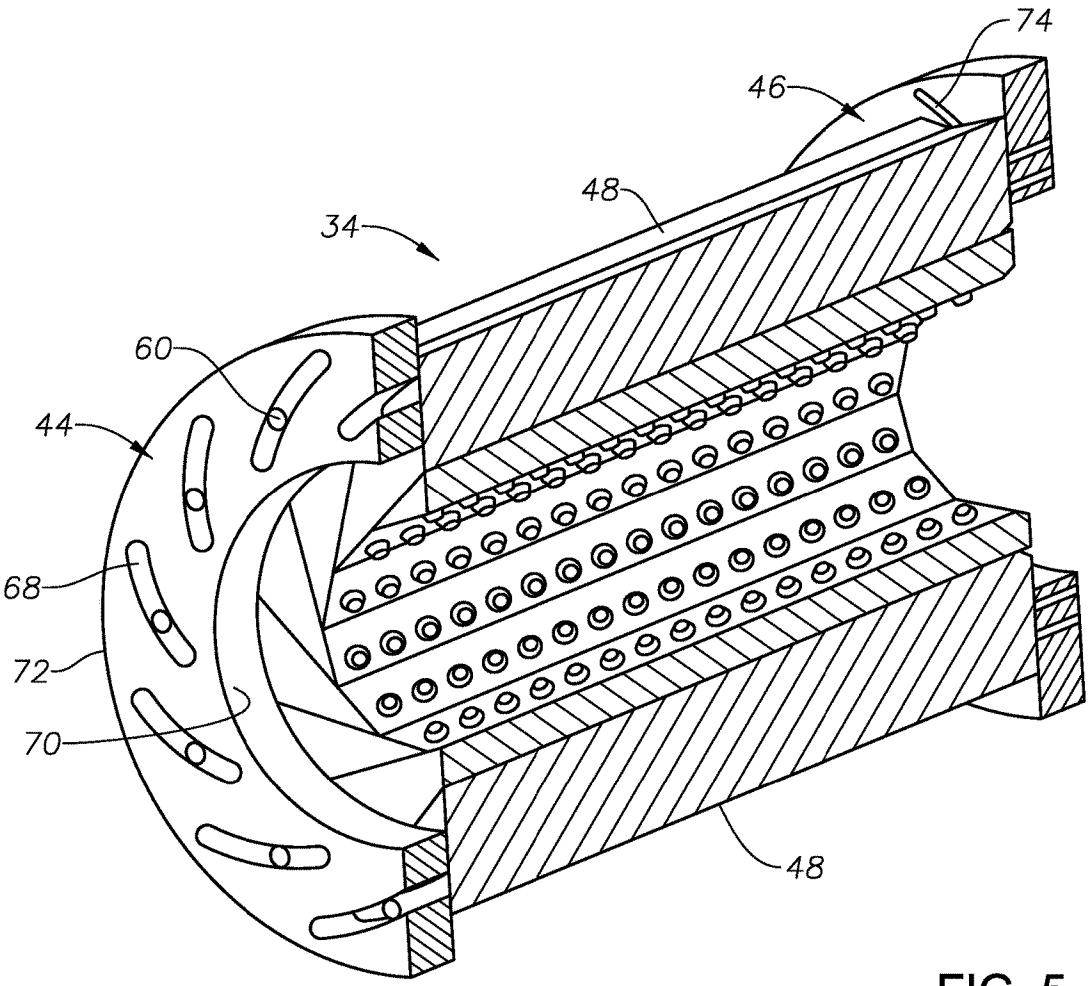
FIG. 5 is cut-away isometric view of the portions of the exemplary gripping assembly shown in FIG. 4.
Figure 6:
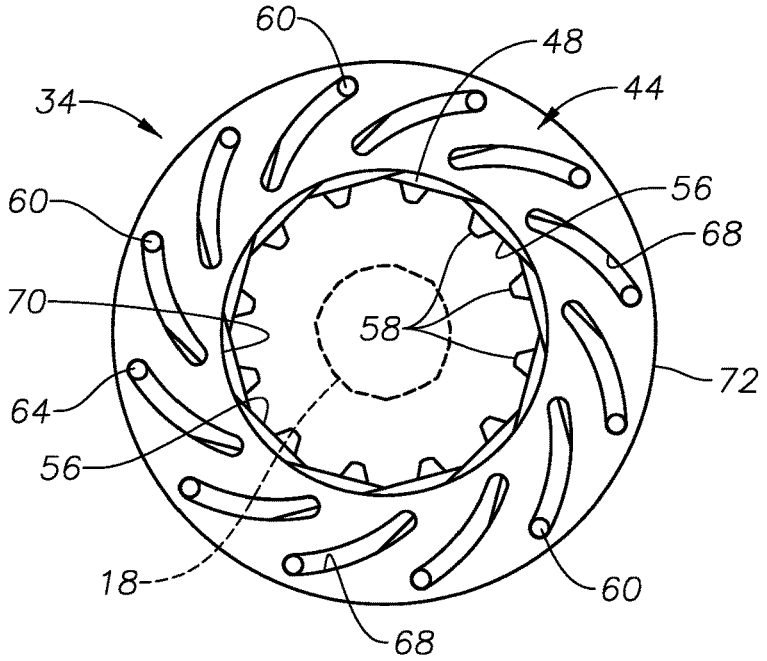
FIG. 6 is an end view of the exemplary gripping assembly of FIGS. 4-5 in an open configuration.
Figure 7:
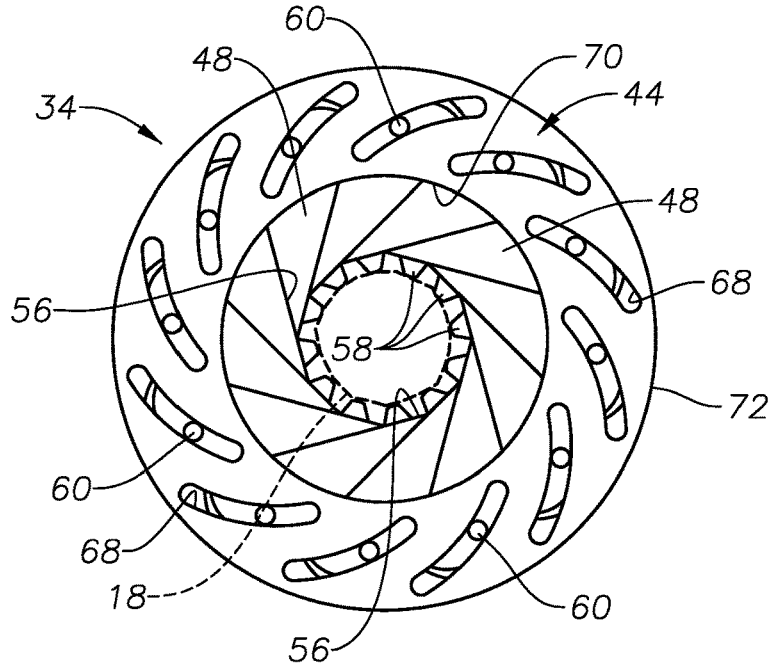
FIG. 7 is an end view of the gripping assembly of FIGS. 4-6, now in a closed, gripping configuration.

Each of the first and second end members 44, 46 contain a plurality of curved slots which are shaped and sized to receive the pins 60, 64 of the gripping segments 48 in a complementary manner and such that the respective pins 60, 64 can slidably move within them. The first end member 44 includes curved slots 68 which extend from a radially inner boundary 70 of the first end member 44 to a radially outer boundary 72 of the first end member 44. The second end member 46 includes curved slots 74 which also extend from a radially inner boundary 76 of the second end member 46 to a radially outer boundary 78 of the second end member 46. As depicted in FIG. 3, the pins 60, 64 are preferably provided with radially enlarged flanges 71 which prevent the pins 60 from being removed from their respective slots 68, 74 during operation. As can be seen by reference to FIGS. 4 and 5, the curved slots 68 of the first end member 44 curve in an opposite direction from the curved slots 74 of the second end member 46. As a result, rotation of the second end member 46 with respect to the first end member 44 will move the gripping segments 48 between a radially expanded configuration (see FIG. 6) and a radially restricted configuration (FIG. 7) which is useful for gripping a fish 16.

Figure 4:
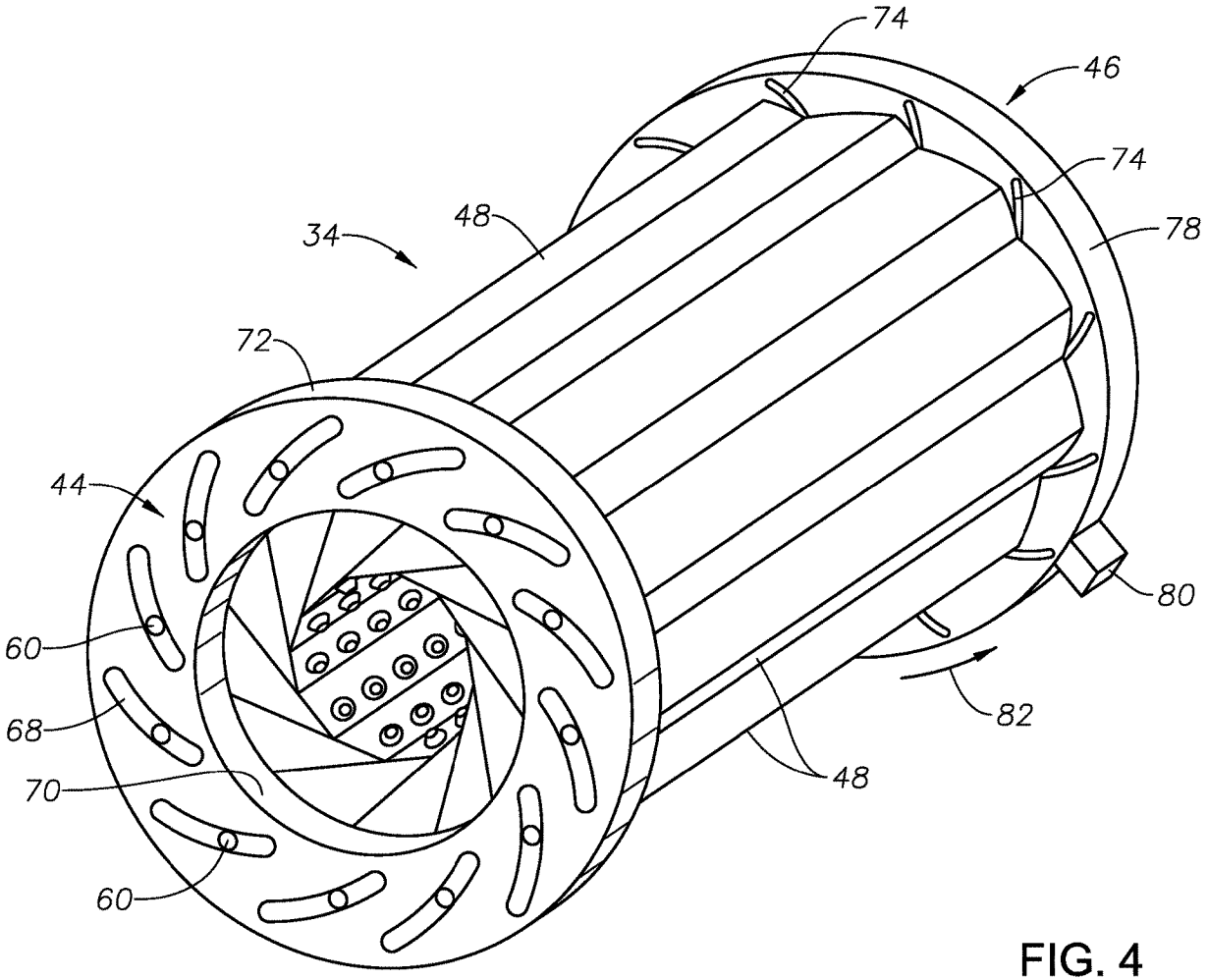
FIG. 4 is an isometric view of portions of an exemplary gripping assembly apart from other components of the fishing tool.

As can best be seen in FIGS. 2 and 4, a lug 80 extends radially outwardly from the second end member 46. The lug 80 is shaped and sized to reside within the helical track 42 in a complementary manner and move within the helical track 42.

The first end member 44 of the gripping assembly 34 is secured to the tube 36 such that the first end member 44 will not rotate with respect to the tube 36 or within the outer housing 32. It is noted that the tube 36 may also be a rod, arm or other structure which is capable of securing the first end member 44 against rotation within the outer housing 32 and which is capable of moving the first end member 44 axially upwardly and downwardly within the outer housing 32. Preferably, the first and second end members 44, 46 are retained in a spaced relation to one another using a bracket or tie rod (not shown).

During operation, the fishing arrangement 20 is run into the wellbore 10 until the overshot portion 30 of the fishing tool 24 surrounds the reduced diameter portion 18 of fish 16. During run-in, the gripping assembly 34 is in the radially expanded configuration shown in FIG. 6. When it is desired to grip the fish 16, the tube 36 is moved axially with respect to the running string 22 in order to move the gripping assembly 34 axially within the surrounding sleeve 38. The lug 80 will move along the helical track 42 and rotate the second end member 46 within the sleeve 38. Rotational movement of the second end member 46 with respect to the first end member 44 will cause the fins 60 of the gripping members 48 to move to a radially inward position along the slots 74 of the second end member 46. In particular, rotation of the second end member 46 in the direction indicated by arrow 82 in FIG. 4 will cause the second pins 64 to be moved radially inwardly along the slots 74. The radial movement of the second pins 64 will cause the gripping members 48 to move radially inwardly to the radially restricted configuration depicted in FIGS. 2, 4-5 and 7. As this occurs, the first pins 60 will be moved to a radially inward position along slots 68 in the first end member 44. The gripping members 48 will contact and grip the reduced diameter portion 18 of the fish 16. In preferred embodiments, the conical projections 58 of the gripping members 48 will engage the fish 16 in a biting engagement. Thereafter, the fishing arrangement 20 can be withdrawn from wellbore 10 bringing the fish 16 with it.

Figure 8:
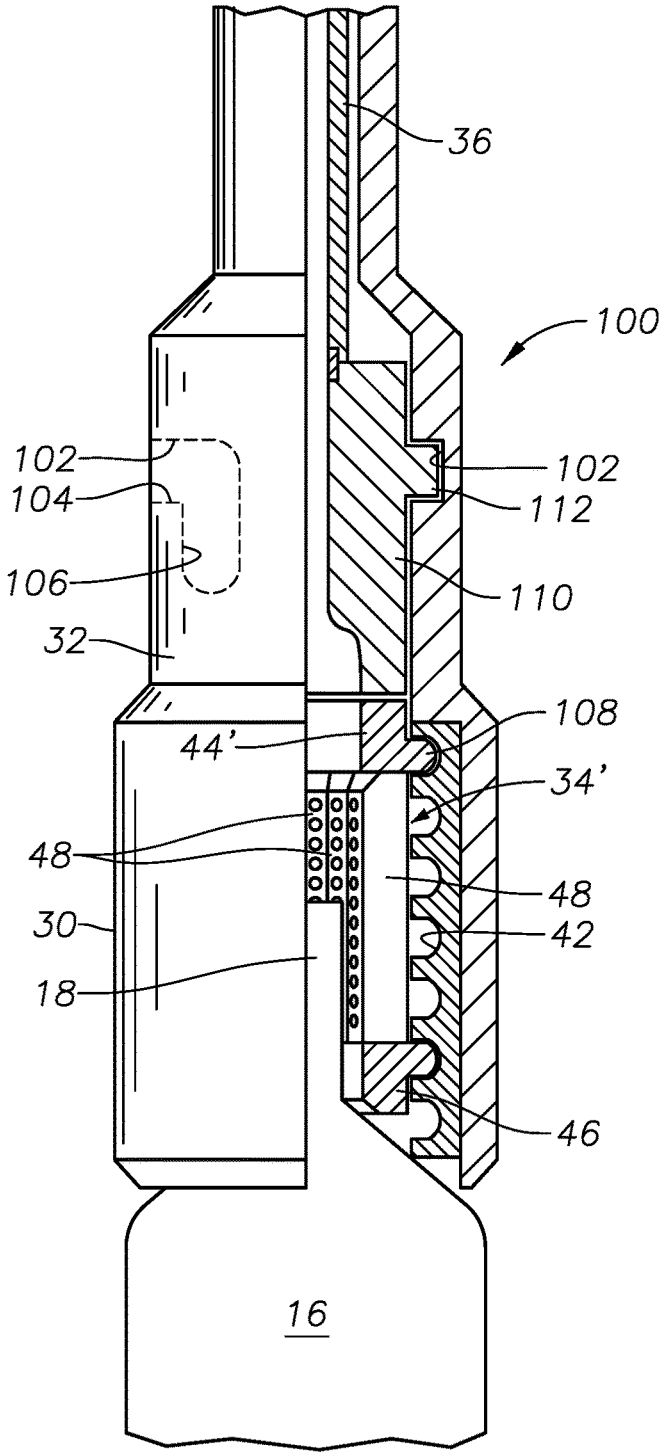
FIG. 8 is a side, one-quarter cut-way view of an alternative fishing tool with a gripping assembly in accordance with the present invention.

FIG. 8 illustrates an alternative construction for a fishing tool 100 in accordance with the present invention wherein a J-slot mechanism helps to control movement of the gripping assembly 34' with respect to the outer housing 32. Except where indicated otherwise, the fishing tool 100 is constructed and operates in the same manner as the fishing tool 24 described previously. A J-slot 102 is inscribed within the outer housing 32. Preferably, the J-slot 102 is located axially above the helical track 42. The J-slot 102 includes a semi-annular track 104 and an axial leg 106 which extends axially downwardly from one end of the semi-annular track 104.

The gripping assembly 34' includes first and second end members 44', 46 and gripping members 48. First end member 44' is preferably provided with a radially-projecting lug 108 which will reside within the helical track 42. A J-slot ring 110 is located axially above and is affixed to the first end member 44'. The J-slot ring 110 is an annular member from which an arm 112 extends radially outwardly. The arm 112 extends into the J-slot 102. Initially, the arm 112 is located within the semi-annular track 104 of the J-slot 102, as shown in FIG. 8.

In operation, the fishing tool 100 is disposed into the wellbore 10 until the outer housing 32 of the fishing tool 100 contacts the fish 16. Weight is set down on the fishing tool 100 at surface to create a frictional engagement between the fish 16 and the outer housing 32. Tube 36 is rotated with respect to the outer housing 32 until the arm 112 of the J-slot ring 110 aligns with the axial leg 106 of the J-slot 102. The gripping assembly 34' is then moved axially downwardly with respect to outer housing 32 as the arm 112 slides downwardly along the axial leg 106. This axial movement of the gripping assembly 34' will cause the gripping members 48 to be moved radially inwardly to grip the reduced diameter portion 18 of the fish 16, as described previously.

Those of skill in the art will recognize that numerous modifications and changes may be made to the exemplary designs and embodiments described herein and that the invention is limited only by the claims that follow and any equivalents thereof.

What is claimed is:

1. A gripping assembly of a fishing tool to grip a fish within a wellbore, the gripping assembly comprising:

a first end member;

a second end member;

a plurality of gripping members that are retained by the first and second end members and which are moveable between a radially expanded configuration and a radially restricted configuration by rotation of the second end member with respect to the first end member; and wherein rotation of the second end member moves the gripping members radially inwardly by moving a pin on each gripping member along a slot within the second end member.

2. The gripping assembly of claim 1 wherein the second end member further comprises a lug extending radially outwardly to move within a helical track such that the second end member is rotated with respect to the first end member as the gripping assembly is moved axially within the outer housing.

3. The gripping assembly of claim 1 further comprising:

slots formed within the first end member;

a first pin extending from an axial end of each gripping member; and the first pin of each gripping member extends within and is moveable within the slot of the first end member to retain the gripping member within the first end member.

4. The gripping assembly of claim 1 wherein the gripping members each present a gripping face to contact and engage the fish.

5. The gripping assembly of claim 4 further comprising at least one projection upon the gripping face to form a biting engagement with the fish.

6. The gripping assembly of claim 1 further comprising a J-slot mechanism to control movement of the gripping assembly with respect to a surrounding outer housing.

7. A fishing tool for gripping a fish within a wellbore, the fishing tool comprising:

an outer housing which is securable to a running string;

a gripping assembly retained within the outer housing for gripping the fish, the gripping assembly having first and second end members and a plurality of gripping members that are retained by the first and second end members and which are moveable between a radially expanded configuration and a radially restricted configuration by rotation of the second end member with respect to the first end member; and wherein the gripping assembly is moved axially with respect to the surrounding outer housing by moving an arm operably associated with the gripping assembly along a J-slot formed within the outer housing.

8. The fishing tool of claim 7 further comprising:

a lug extending radially outwardly from the second end member; and a helical track formed within the outer housing and wherein the lug moves within the helical track such that the second end member is rotated with respect to the first end member as the gripping assembly is moved axially within the outer housing.

9. The fishing tool of claim 7 further comprising:

slots formed within the first end member;

a first pin extending from an axial end of each gripping member; and the first pin of each gripping member extends within and is moveable within the slot of the first end member to retain the gripping member within the first end member.

10. The fishing tool of claim 7 further comprising:

a plurality of curved slots formed within the second end member; and a second pin extending from each of the gripping members, each second pin residing within a curved slot in the second end member and moveable within the curved slot between a radial outer position and a radially inner position.

11. The fishing tool of claim 7 wherein the gripping members each present a gripping face to contact and engage the fish.

12. The fishing tool of claim 11 further comprising at least one projection upon the gripping face to form a biting engagement with the fish.

13. A method of gripping a fish within a wellbore comprising the steps of:

disposing a fishing tool into a wellbore, the fishing tool having a gripping assembly retained within the outer housing for gripping the fish, the gripping assembly having first and second end members and a plurality of gripping members that are retained by the first and second end members and which are moveable between a radially expanded configuration and a radially restricted configuration by rotation of the second end member with respect to the first end member;

surrounding a portion of the fish with the gripping assembly; and moving the gripping assembly from the radially expanded configuration to the radially restricted configuration to grip the fish, wherein rotation of the second end member moves the gripping members radially inwardly by moving a pin on each gripping member along a slot within the second end member.

14. The method of claim 13 wherein the second end member is rotated by moving the gripping assembly axially with respect to a surrounding outer housing.

15. The method of claim 14 wherein the step of moving the gripping assembly axially with respect to the surrounding outer housing further comprises moving an arm operably associated with the gripping assembly along a J-slot formed within the outer housing.

* * * * *